US009151170B2

(12) United States Patent
El-Aini et al.

(10) Patent No.: US 9,151,170 B2
(45) Date of Patent: Oct. 6, 2015

(54) DAMPER FOR AN INTEGRALLY BLADED ROTOR

(75) Inventors: Yehia M. El-Aini, Tequesta, FL (US); Gary A. Davis, Camarillo, CA (US)

(73) Assignee: United Technologies Corporation, Hartford, CT (US)

( * ) Notice: Subject to any disclaimer, the term of this patent is extended or adjusted under 35 U.S.C. 154(b) by 838 days.

(21) Appl. No.: 13/170,433

(22) Filed: Jun. 28, 2011

(65) Prior Publication Data

US 2013/0004313 A1 Jan. 3, 2013

(51) Int. Cl.
*F01D 5/10* (2006.01)
*F01D 5/34* (2006.01)

(52) U.S. Cl.
CPC ... *F01D 5/34* (2013.01); *F01D 5/10* (2013.01)

(58) Field of Classification Search
CPC ..... F01D 5/34; F01D 5/10
USPC ..... 416/190, 500; 415/119
See application file for complete search history.

(56) References Cited

U.S. PATENT DOCUMENTS

| | | | | | |
|---|---|---|---|---|---|
| 1,856,786 | A | * | 5/1932 | Rice | 416/244 R |
| 4,480,959 | A | | 11/1984 | Bourguignon et al. | |
| 4,817,455 | A | * | 4/1989 | Buxe | 416/144 |
| 4,835,958 | A | * | 6/1989 | Rice | 60/775 |
| 5,346,362 | A | * | 9/1994 | Bonner et al. | 415/191 |
| 5,373,922 | A | | 12/1994 | Marra | |
| 5,498,137 | A | * | 3/1996 | El-Aini et al. | 416/229 A |
| 5,725,355 | A | | 3/1998 | Crall et al. | |
| 5,733,103 | A | * | 3/1998 | Wallace et al. | 416/248 |
| 6,039,542 | A | | 3/2000 | Schilling et al. | |
| 6,155,789 | A | * | 12/2000 | Mannava et al. | 416/241 R |
| 6,471,484 | B1 | | 10/2002 | Crall | |
| 6,494,679 | B1 | * | 12/2002 | Gadre et al. | 416/145 |
| 6,607,359 | B2 | | 8/2003 | von Flotow | |
| 6,676,380 | B2 | | 1/2004 | Davis et al. | |
| 6,685,435 | B2 | | 2/2004 | Davis et al. | |
| 6,699,015 | B2 | | 3/2004 | Villhard | |
| 6,752,594 | B2 | * | 6/2004 | Miller et al. | 416/1 |
| 6,796,408 | B2 | | 9/2004 | Sherwin et al. | |
| 6,827,551 | B1 | | 12/2004 | Duffy et al. | |
| 6,886,622 | B2 | | 5/2005 | Villhard | |
| 6,891,280 | B2 | | 5/2005 | Siegfriedsen | |
| 6,893,211 | B1 | | 5/2005 | Eibl et al. | |
| 7,334,998 | B2 | | 2/2008 | Jones et al. | |
| 7,445,685 | B2 | | 11/2008 | Deakin et al. | |
| 7,458,769 | B2 | * | 12/2008 | Forgue et al. | 415/119 |
| 7,534,090 | B2 | * | 5/2009 | Good et al. | 416/193 A |
| 7,607,287 | B2 | | 10/2009 | Reba et al. | |
| 7,806,410 | B2 | | 10/2010 | El-Aini et al. | |
| 2006/0163828 | A1 | * | 7/2006 | Renz et al. | 280/79.11 |
| 2007/0020089 | A1 | * | 1/2007 | Forgue et al. | 415/119 |
| 2009/0214347 | A1 | * | 8/2009 | Cloarec | 416/204 A |
| 2011/0049215 | A1 | * | 3/2011 | McAfee et al. | 227/137 |

FOREIGN PATENT DOCUMENTS

| | | | | |
|---|---|---|---|---|
| GB | 2255138 | | 10/1992 | |
| GB | 2255138 | A * | 10/1992 | F01D 5/10 |

* cited by examiner

*Primary Examiner* — Edward Look
*Assistant Examiner* — Aaron R Eastman
(74) *Attorney, Agent, or Firm* — Carlson, Gaskey & Olds, PC

(57) ABSTRACT

A Rotor includes a disk having a rim with an axial face, the rim defines a circumferential groove. A damper engaged with the rim at both the axial face and the circumferential groove.

1 Claim, 4 Drawing Sheets

DAMPER FOR AN INTEGRALLY BLADED ROTOR

BACKGROUND

The present disclosure relates to an integrally bladed rotor (IBR), and more particularly to a damper system therefor.

Turbomachinery may include a rotor such as an integrally bladed rotor (IBR). The IBR eliminates individual blade attachments and shrouds but has reduced inherent rotor damping. Reduced damping may result in elevated vibratory responses and potentially High Cycle Fatigue. Systems which involve friction dampers may be utilized to dissipate energy and augment rotor damping.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
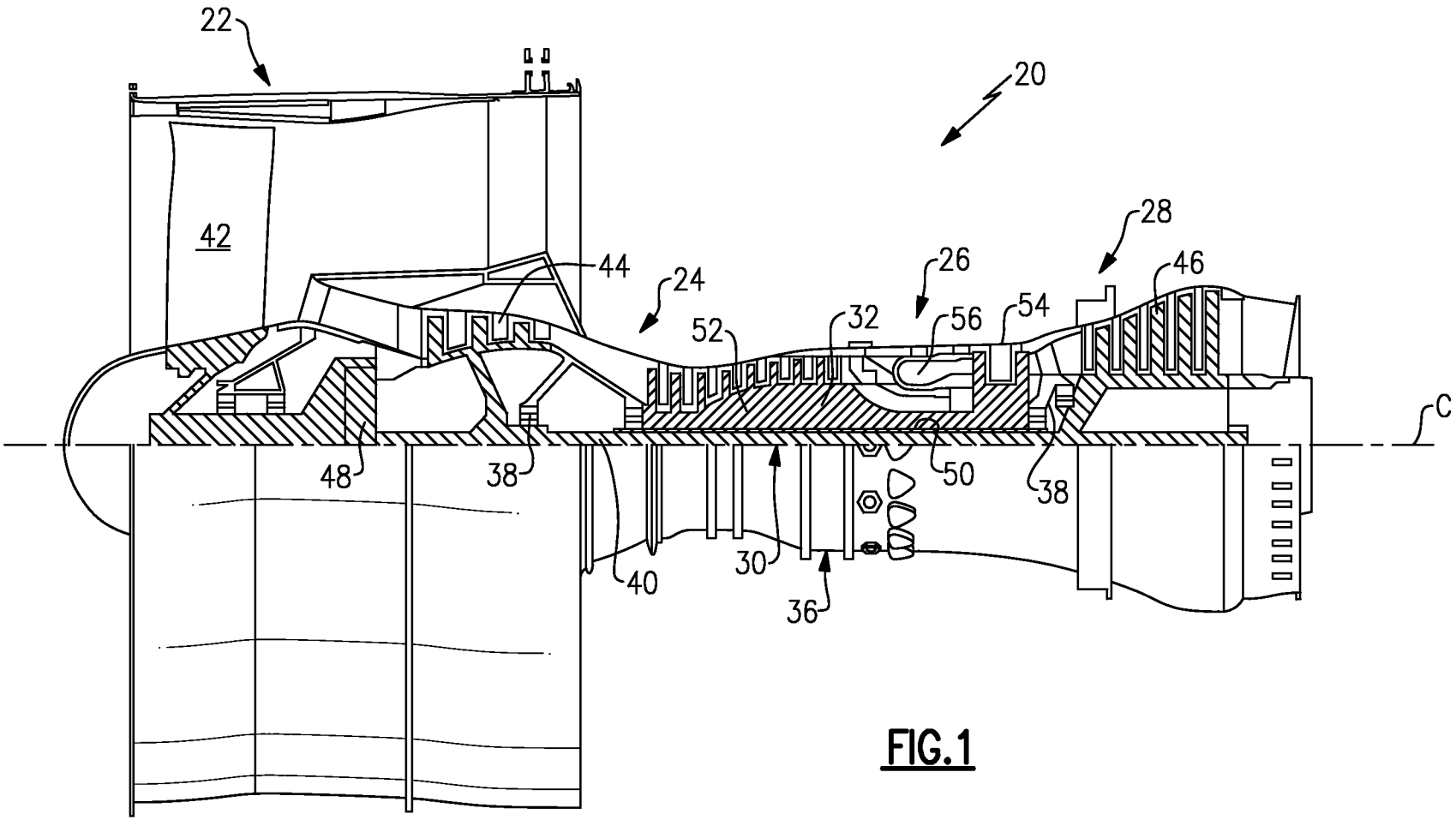
FIG. 1 is a general schematic view of an exemplary gas turbine engine for use with the present disclosure.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines.

The engine 20 generally includes a low speed spool 30 and a high speed spool 32 mounted for rotation about an engine central longitudinal axis C relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. The inner shaft 40 and the outer shaft 50 are concentric and rotate about the engine central longitudinal axis C which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 54, 46 rotationally drive the respective low speed spool 30 and high speed spool 32 in response to the expansion.

Figure 2:
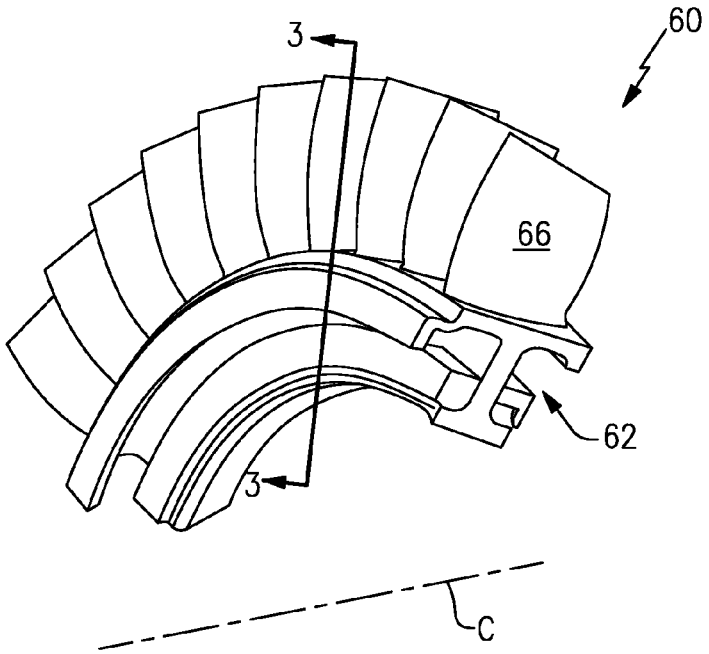
FIG. 2 is a perspective, partial sectional view of a IBR.

With reference to FIG. 2, an integrally bladed rotor (IBR) 60 generally includes a rotor hub 62 from which a multiple of integrally machined airfoils 66 extend for rotation about axis C. It should be understood that the IBR 60 may be utilized in the fan section 22, the compressor section 24 and the turbine section 28 of the engine 20 as well as in other turbomachinery.

Figure 3:
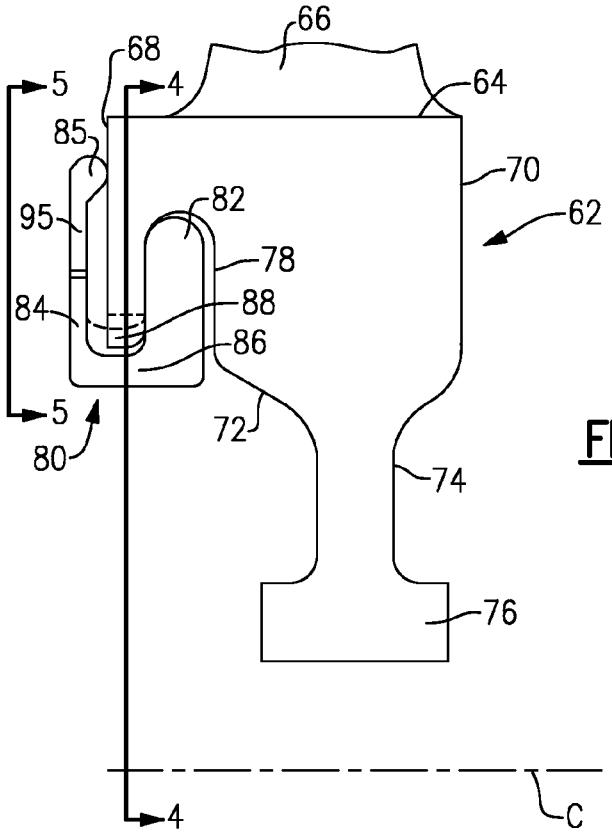
FIG. 3 is a radial sectional view of the IBR illustrating a split ring damper mounted thereto taken along line 3-3 in FIG. 2.

With reference to FIG. 3, an outer hub rim 64 and a hub inner surface 72 are defined between a front face 68 and a rear face 70. The hub inner surface 72 is generally opposite the outer hub rim 64 and may be of various contours. In one non-limiting embodiment, the hub inner surface 72 may extend radially inward to define a web 74 and an inner bore 76.

The hub inner surface 72 defines a circumferential groove 78 which receives a split ring damper 80. The split ring damper 80 is generally U-shaped in cross-section with a first leg 82 and a second leg 84 interconnected by an interface 86. The split ring damper 80 may be manufactured of a steel or titanium alloy with a coefficient of friction in the range of 0.20 to 0.60. The split ring damper 80 may also be coated with a silver or other coating material to provide a desired coefficient of friction.

The first leg 82 is engaged with the groove 78 and the second leg 84 is adjacent to the face 68, 70 of the rotor hub 62. It should be understood that a split ring damper 80 may be mounted adjacent to either or both faces 68, 70. The second leg 84 may include a bulbed end 85 which rides upon the face 68, 70. Dependant on, for example, the sensitivity of the vibration modes, the groove 78 may be of various widths to provide a desired rim stiffness.

Figure 4:
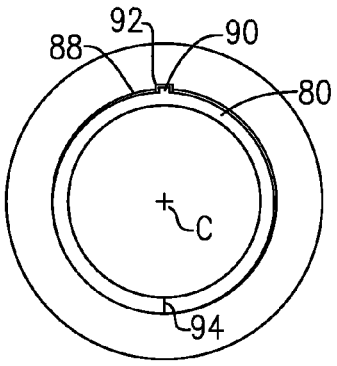
FIG. 4 is a facial sectional view of the IBR illustrating a split ring damper mounted thereto taken along line 4-4 in FIG. 3.

The interface 86 between the first leg 82 and the second leg 84 surrounds a radial lip 88 of the hub inner surface 72. A tab 90 on the split ring damper 80 engages a slot 92 on the radial lip 88 generally opposite a split 94 in the split ring damper 80 (FIG. 4). At zero rotational speed, the split ring damper 80 has sufficient assembly preload to maintain engagement with the rotor hub 62 up to, for example, 20 Gs to prevent accidental disengagement.

Figure 5:
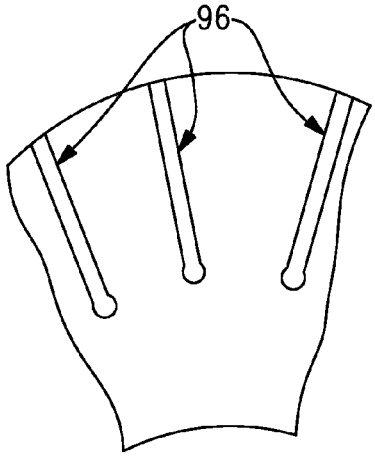
FIG. 5 is a partial facial sectional view of the IBR illustrating a split ring damper mounted thereto taken along line 5-5 in FIG. 3.

The second leg 84 includes a multiple of radially extending slits 96 (FIG. 5) which reduce the hoop stiffness for ease of assembly and conformity. In one disclosed non-limiting embodiment, the multiple of radially extending slits 96 extend for approximately 50% of the radial length of second leg 84.

Figure 6A:
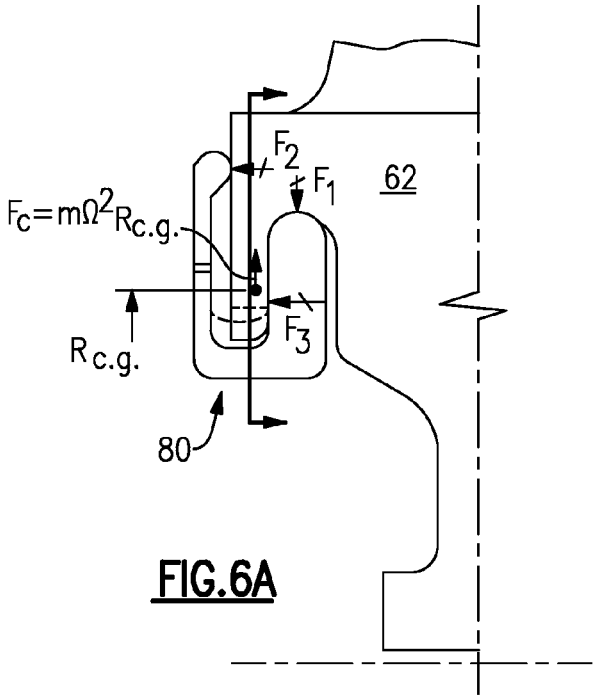
FIG. 6A is an idealization schematic representation of a force balance between the split ring damper and the IBR.

An idealization of the force balance at the split ring damper 80 contact interface is schematically illustrated in FIG. 6A. At operational speeds, the split ring damper 80 is in equilibrium. The applied centrifugal load $F_c$ is reacted by contact forces F1, F2, and F3. The contact at three separate locations maximizes the benefits due to the expected slip as the dissipated energy of the system is additive from all sources for a given mode of vibration. The split ring damper 80 minimizes the impact on rim stiffness and provides multiple points of contact which capture both axial and radial deflections to provide a respectively higher system damping.

It should be noted that an optimum configuration is stiff in the circumferential direction yet light weight to ensure slip will take place. This is expressed in the well known relationship:

$$K\Delta \rangle \mu N$$

where

K=damper stiffness in the tangential direction,

Δ=deflection of damper,

μ=coefficient of friction between damper and IBR.

N=the contact force normal to the direction of damper motion.

Figure 6B:
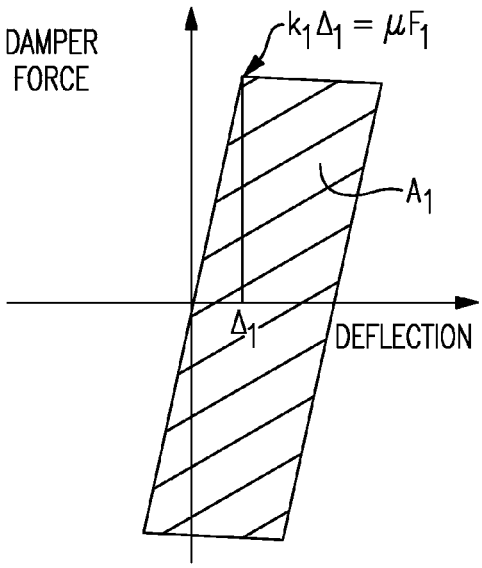
FIG. 6B is an idealization schematic representation of slip.

For a single point of contact, for example, point 1, the condition for slip is $K_1\Delta_1 \rangle \mu F_1$ as shown in FIG. 6B.

The amount of energy dissipated during one cycle of oscillation is the shaded area $A_1$. For multiple points of contact undergoing large enough vibration amplitudes, slip will occur at each location contributing to the overall system damping A*, where $$A^* = \sum_{i=1}^{3} A_i$$

Figure 7:
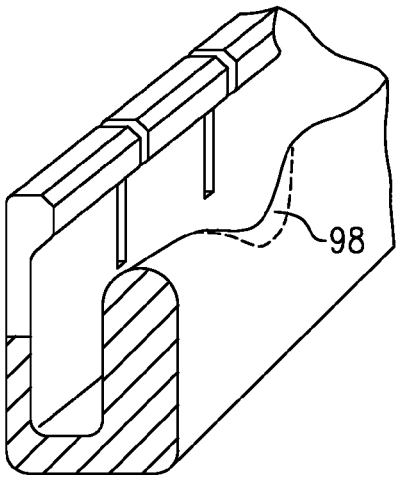
FIG. 7 is a perspective view of a portion of the split ring damper illustrating a non-limiting embodiment of a lightening feature.
Figure 8:
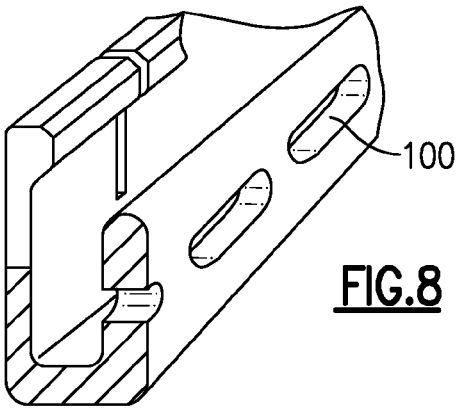
FIG. 8 is a perspective view of a portion of the split ring damper illustrating another non-limiting embodiment of a lightening feature.

With reference to FIG. 7, the first leg 82 may include scallops 98 to reduce weight yet maintain relatively high stiffness. Alternatively, lightening apertures 10 may be formed through the first leg 82 (FIG. 8).

Figure 9:
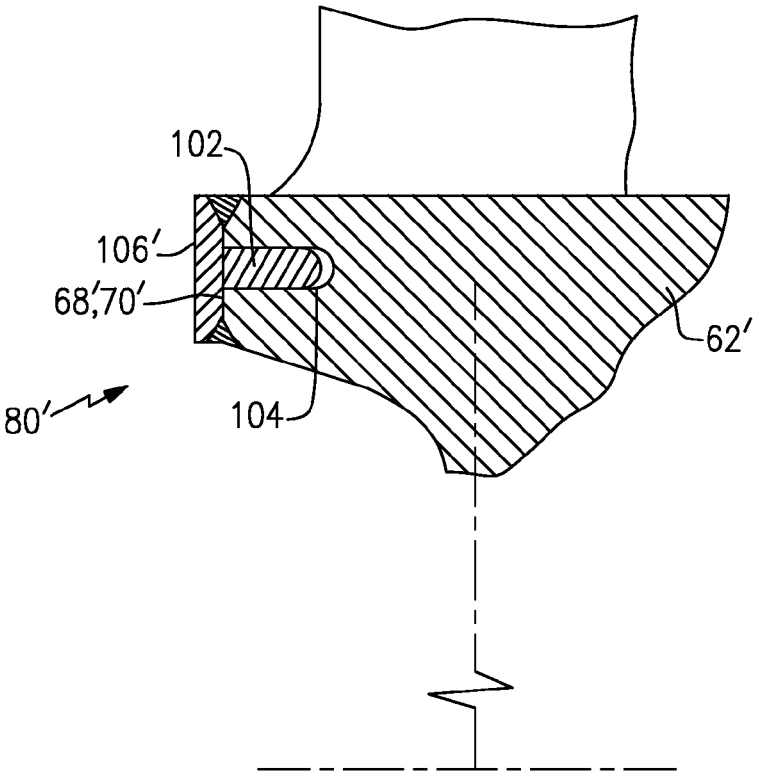
FIG. 9 is another non-limiting embodiment of a split ring damper.

With reference to FIG. 9, another non-limiting embodiment of the split ring damper 80' includes a damper ring 102 mounted within a groove 104 formed in the face 68', 70' of the rotor hub 62'. The damper ring 102 is contained within the groove 104 with a cover 106 welded or otherwise attached to the face 68', 70'.

The split ring damper 80 is effective for both axial and radial modes, does not result in a significant change of rim stiffness such that the airfoil fundamental mode frequencies are not changed by more than 1 to 2%; provides multiple points of contact which capture both axial and radial deflections resulting in higher system damping; and does not clock circumferentially relative to the disk to assure the maintenance of rotor balance.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. An integrally bladed rotor comprising:

a rotor hub that defines a hub face facing one of a forward or rearward direction and a hub rim transverse to said hub face;

a multiple of airfoils integral with said hub rim;

a split ring damper mounted to said rotor hub and including a portion in contact with said hub face;

wherein said rotor hub comprises a hub inner surface facing a longitudinal axis about which said rotor hub rotates and said hub rim being spaced radially outwardly relative to said hub inner surface, and wherein said hub face extends radially inwardly from said hub rim to said hub inner surface; and including a circumferential groove formed within said hub inner surface, and wherein said spilt ring damper includes a first leg mounted within said circumferential groove and a second leg that extends from said first leg to surround a radial lip of said hub inner surface and to contact said hub face.

* * * * *

UNITED STATES PATENT AND TRADEMARK OFFICE

CERTIFICATE OF CORRECTION

PATENT NO. : 9,151,170 B2
APPLICATION NO. : 13/170433
DATED : October 6, 2015
INVENTOR(S) : Yehia M. El-Aini et al.

It is certified that error appears in the above-identified patent and that said Letters Patent is hereby corrected as shown below:

IN THE CLAIMS:

In claim 1, column 4, line 43; delete "spilt" and replace with --split--

Signed and Sealed this
Second Day of August, 2016

Michelle K. Lee

Michelle K. Lee
*Director of the United States Patent and Trademark Office*